United States Patent [19]

Kardos et al.

[11] 4,390,004

[45] Jun. 28, 1983

[54] UNIVERSAL FURNACE

[75] Inventors: Karl Kardos, Mölnlycke; Bertil Mattsson, Gothenburg; Olle Westermark, Falköping, all of Sweden

[73] Assignee: Produktutvecklingscentrum i Goteborg, Gothenburg, Sweden

[21] Appl. No.: 221,548

[22] PCT Filed: May 6, 1980

[86] PCT No.: PCT/SE80/00131

§ 371 Date: Jan. 7, 1981

§ 102(e) Date: Dec. 31, 1980

[87] PCT Pub. No.: WO80/02454

PCT Pub. Date: Nov. 13, 1980

[30] Foreign Application Priority Data

May 7, 1979 [SE] Sweden ..... 7903968

[51] Int. Cl.[3] ..... F24H 3/06

[52] U.S. Cl. ..... 126/104 A; 126/99 D; 126/61

[58] Field of Search ..... 126/99 D, 110 D, 117, 126/108, 104 A, 105 R, 60, 61, 66, 67, 136, 105 A, 104 R, 121, 123, 125, 126, 131

[56] References Cited

U.S. PATENT DOCUMENTS

| | | | |
|---|---|---|---|
| 1,399,756 | 12/1921 | Ellison | 126/104 R |
| 2,109,876 | 3/1938 | Bard | 126/99 D |
| 3,995,611 | 12/1976 | Nelson | 126/131 |
| 4,140,101 | 2/1979 | Glover | 126/66 |
| 4,200,086 | 4/1980 | Klob | 126/66 |
| 4,206,744 | 6/1980 | Mahoney | 126/131 |

FOREIGN PATENT DOCUMENTS

| | | | |
|---|---|---|---|
| WO80/01409 | 7/1980 | PCT Int'l Appl. | 126/110 D |
| 2043850 | 10/1980 | United Kingdom | 126/99 D |

*Primary Examiner*—Daniel J. O'Connor
*Assistant Examiner*—G. Anderson
*Attorney, Agent, or Firm*—Holman & Stern

[57] ABSTRACT

A furnace for firing with optional fuels and where the substantial heat transfer takes place from air to air, whereby the furnace (1) is provided with double shells, which in the space therebetween present partition members (10) which subdivide the space in at least two zones (2,3) through which air is forced by at least one blower (6) from an inlet at one end of the furnace, via a first one of said zones and thereupon via the second one of said zones to an outlet (5) at the same one end of the furnace, whereby the air is brought carefully to flow around the combustion chamber shell.

7 Claims, 16 Drawing Figures

UNIVERSAL FURNACE

BACKGROUND OF THE INVENTION

1. Field of the Invention

The present invention refers to a furnace for firing with optional fuels.

2. Description of the Prior Art

Furnances nowadays used often have a limited usefullness. This is a particularly pronounced deficiency, e.g., in agriculture where for drying of crops there is temporarily needed large supplies of hot air. Special furnaces for this purpose which are available on the market are generally designed to be useable only for such purpose and can only be fired with liquid fuels. This is an evident drawback as the farmer often has at his disposal comparatively cheap, solid fuels of different types.

BRIEF SUMMARY OF THE INVENTION

The object of the present invention is to provide a furnace which can not only be used for production of hot air, but which is also adaptable in other ways for forming a universal furnace which is highly adaptable to different working conditions and performance desires, e.g for hot water heating, for heating of farm buildings and dwelling-houses etc. and this is achieved with the furnace according to the invention by means of the characteristic features defined in the following description and annexed claims. The basic concept of the invention can lead to several different system solutions in which the entire system can have different designs beside the fact that the main components forming part of the system may be varied, although many of the details are known per se to an expert.

DESCRIPTION OF THE DRAWINGS

The invention will hereinafter be further described with reference to a number of embodiments schematically shown in the accompanying drawings wherein.

DETAILED DESCRIPTION OF THE PREFERRED EMBODIMENTS

Figure 1:
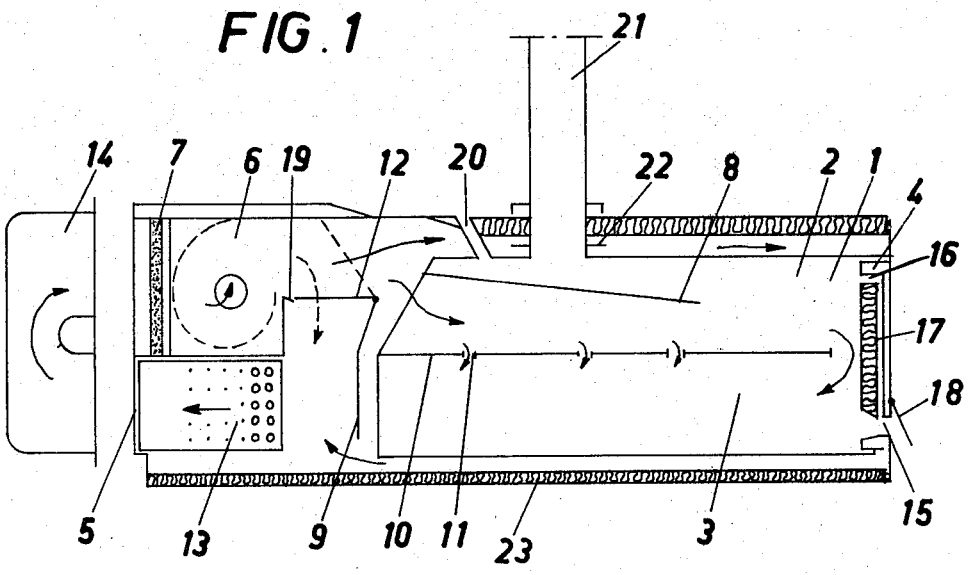
FIG. 1 is a schematic cross-sectional view through an embodiment of a furnace according to the invention.

In FIG. 1 is schematically shown in a longitudinal section a combustion chamber 1 surrounded by two shells, where the outer one is provided with a furnace insulation 23. The space between the two shells is by means of sheet metal partitions 10 subdivided into an upper and a lower zone 2 and 3 respectively. In the upper zone air flow against the furnace front side, which is provided with a door 4 for introduction of fuel. The primary air for the combustion passes through an opening 15 in the front side of the furnace and secondary air is supplied from the opening 15 via a duct 17 through the door 4 to a secondary air inlet 16. The supply of primary as well as secondary air is preferably controlled by means of a thermostatic valve controlled adjuster which acts upon a draught door 18. The air passes from the upper zone 2 at the front part of the furnace over to the second, lower zone 3, but the partitions 10 are furthermore equipped with a number of perforations 11, which allow smaller flows between the first and the second zones along a major part of the partitions 10. The heat transfer is thereby increased at the same time as the cooling of the combustion chamber will be improved also in the second zone, which without such leak flow would only be cooled by air, that had already passed through the entire first zone where it would have been heated.

The air supplied to the first zone 2 is delivered from a blower 6 which takes in fresh air via a filter 7 and blows the cold air against the rear, inclined part of the combustion chamber 1. In order to obtain such a satisfactory cooling of the combustion chamber as possible the space between the two shells is furthermore provided with guide plates 8,9 intended to guide the flow of air so that it will flow around the combustion chamber as well as possible, whereby a satisfactory cooling thereof is obtained. The heated air passes from the second zone out through an outlet 5, and as shown in this figure, before this outlet there can be located a heat exchanger 13, which can work with heat transfer air to air or air to water. A draft valve device 12 is arranged to be adjustable from the position shown in continuous lines, in which the cold air passes through the furnace in the manner described above, to the position shown in dash lines, in which the cold air is guided directly to the outlet 5. A separate mountable guide duct 14 can also be connected to prevent hot air from passing out through the outlet 5 and instead to lead the hot air back to the heat exchanger system of the furnace via the filter 7 provided before the blower. This system can preferably be used when it is desired to heat water in the heat exchanger 13. The smoke gases from the furnace are drawn off via a funnel 21 provided with a cooling flange 22. The speed of the blower and the opening 19 of the draft valve are adjusted manually or automatically in relation to desired parameters. At extremely high furnace temperatures it is possible to supply the furnace with a cooling agent through an opening 20.

The apparatus part with blower, draft valve and possible control equipment is preferably formed as an integral unit which is detachable from the combustion chamber. It is thereby possible to use the same apparatus part for furnaces of different sizes.

Figure 2:
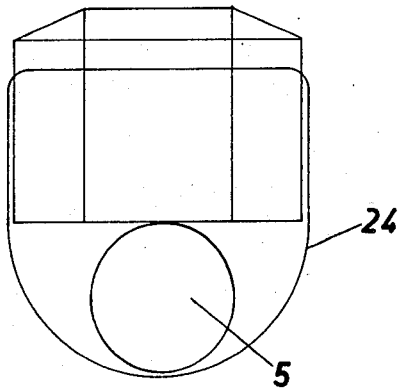
FIG. 2 is an end view of the furnace according to FIG. 1.
Figure 3:
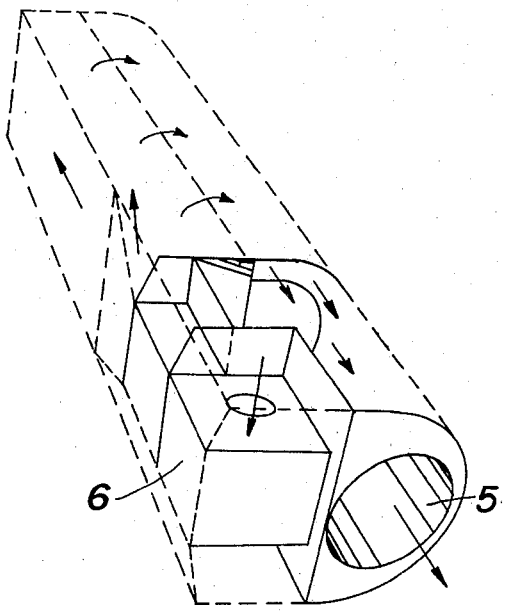
FIG. 3 is a schematic perspective view of the furnace according to FIG. 1.

In FIG. 2 is shown in an end view the main principle of the furnace geometry 24 and in FIG. 3 is shown in a schematic perspective view partly as a ghost view the structure and the location of the blower and the draft valve with control equipment in the furnace according to FIGS. 1 and 2.

Figure 4:
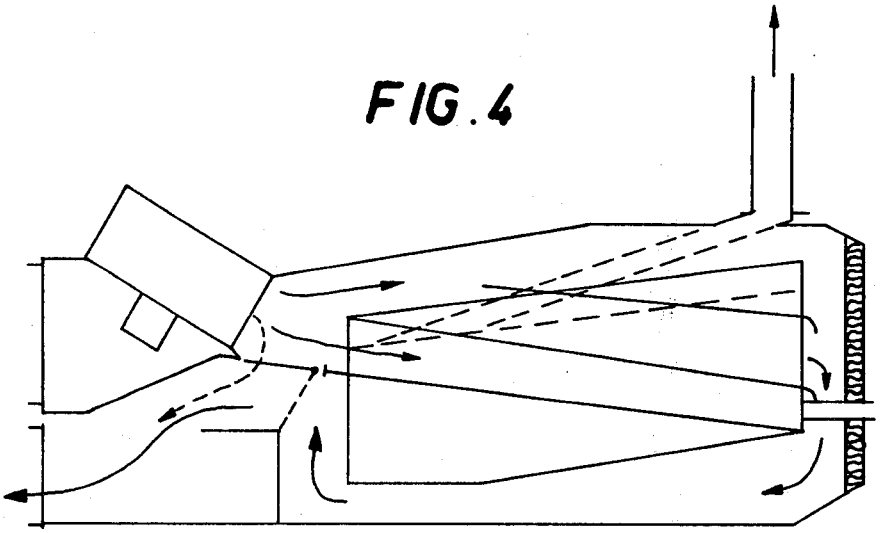
FIG. 4 is a longitudinal schematic sectional view through a modified embodiment of a furnace according to the invention.

In FIG. 4 is shown in modified embodiment, whereby the combustion chamber as well as the blower have been tilted at the same time as the funnel has been located at the forward part of the furnace whereby a longer cooling duct for the smoke gases is obtained before the funnel, which makes it possible to obtain a better cooling of these smoke gases.

Figure 5A:
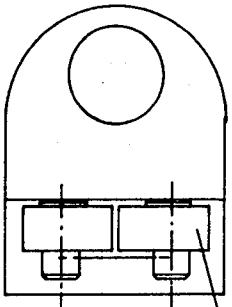
FIGS. 5*a* and 5*b* are an end view and a longitudinal sectional view of a further modified embodiment, respectively.
Figure 5B:
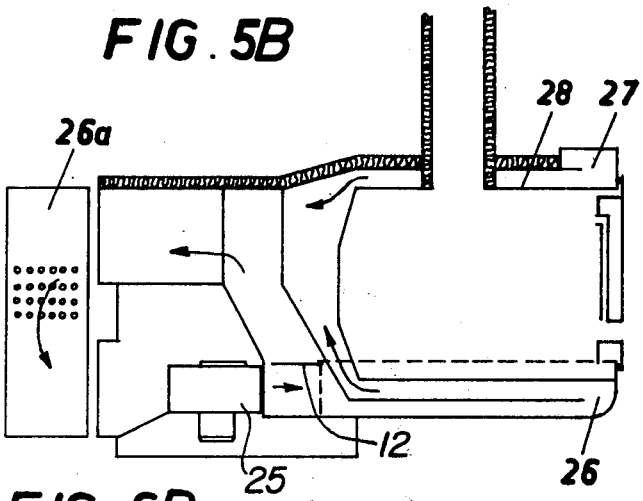

In FIGS. 5*a* and 5*b* are shown in an end view and a longitudinal section respectively a furnace in which the air by means of two underlying blowers 25 is supplied through a duct 26 located below the furnace, whereupon the air is distributed in a distribution compartment 27 arranged circumferentially around the shell wall 28 of the combustion chamber. A separate heat exchanger 26*a* is connectable to the rear part of the furnace. The design corresponds in other essential details to the embodiments according to FIG. 1.

Figure 6A:
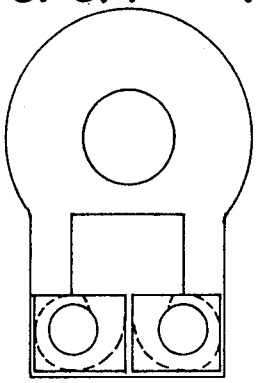
FIGS. 6*a* and 6*b* are an end view and longitudinal sectional view through still another embodiment, respectively.
Figure 6B:
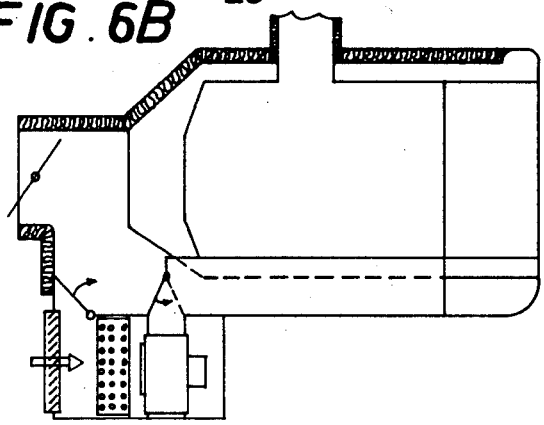

In FIGS. 6*a* and 6*b* are shown in views corresponding to FIG. 5 alternative locations of the blowers and heat exchangers together with draft valve, whereby however the other details correspond to those earlier described.

Figure 7:
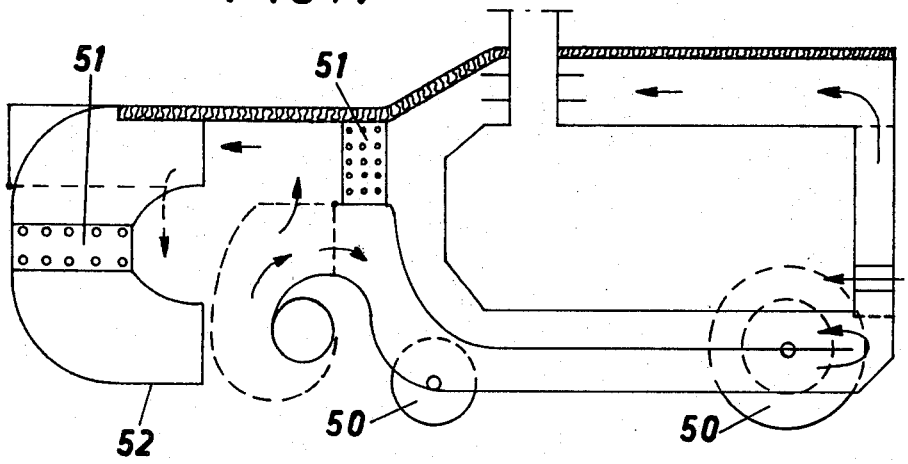
FIG. 7 is a schematic longitudinal sectional view through a further embodiment of the invention.

In FIG. 7 is shown a modification of the preceding embodiments with a mobile furnace which can be equipped with wheels 50 and which can furthermore be provided with several heat exchanger batteries 51 arranged in the exhaust air duct or in a guide duct 52 which is connectable between the exhaust air duct and the supply air duct.

Figure 8:
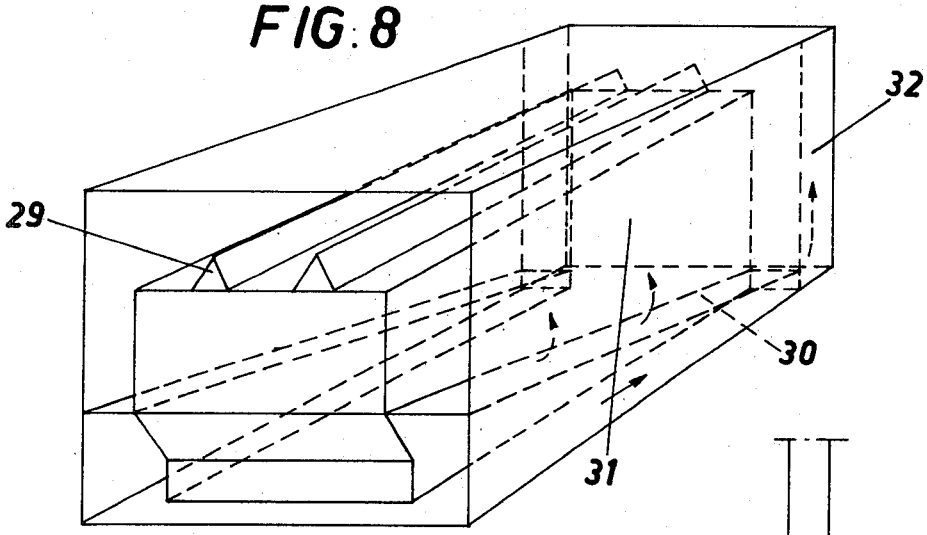
FIG. 8 is a perspective schematic view of a combustion chamber with quadrangular geometry.

In FIG. 8 is shown a combustion chamber having a quadrangular geometry, whereby the upper surface of the combustion chamber is provided with cooling flanges 29. The cold air is here supplied at the lower part of the furnace below the partition 30 which is provided with smaller openings for air distribution to the sides 31 of the combustion chamber. The main part of the air from the first zone is however distributed via the distribution compartment 32 and is by the upper zone led to the outlet.

Figure 9:
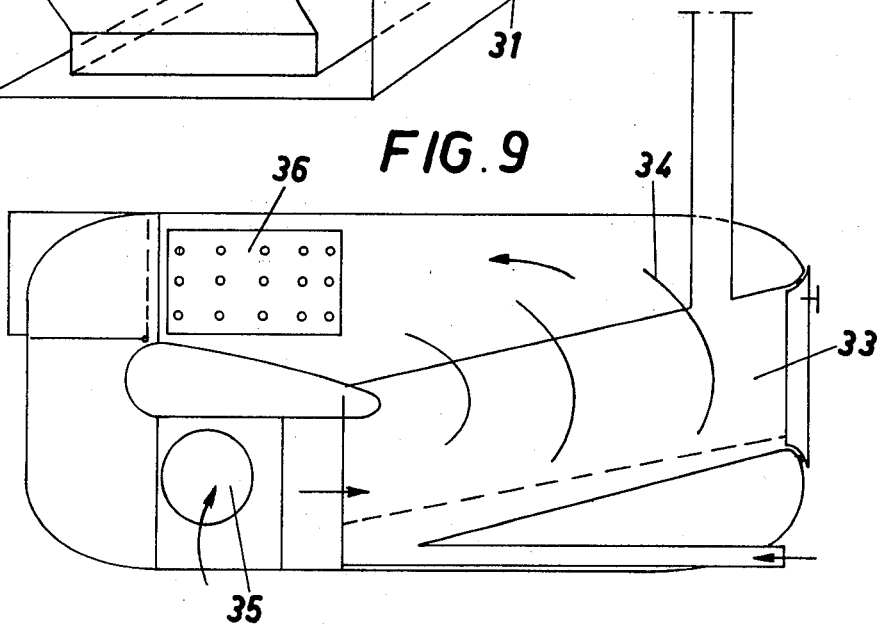
FIG. 9 is a schematic longitudinal sectional view through a further modified furnace design.

FIG. 9 shows a furnace with an inclined combustion chamber 33 and with vanes 34 for still improved distribution of the air which passes around the furnace and between the two zones. In this case the blower 35 is located at the outlet side and the supply of air takes place by means of suction. A separate heat exchanger 36 can be connected in such a manner that it is utilized to an optimum only when the hot air production is interrupted.

Figure 10A:
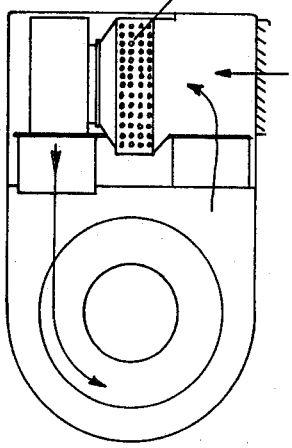
FIGS. 10*a* and 10*b* are an end view and a schematic longitudinal cross-section respectively of a furnace design having a modified supply.
Figure 10B:
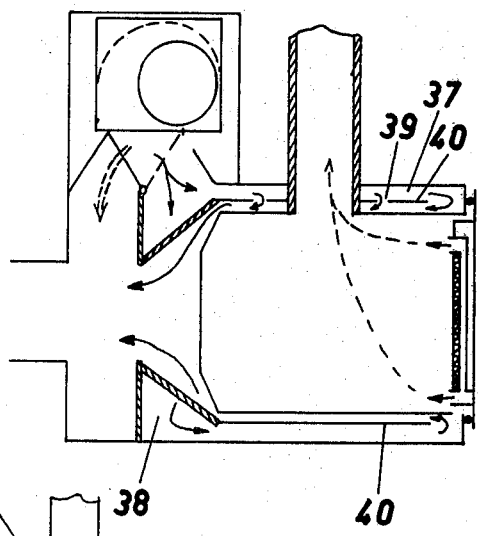

In FIGS. 10*a* and 10*b* are shown a furnace in end view and side view in which the air is supplied from one side of the furnace in an outer shell 37 around the entire combustion chamber. The air is distributed at the rear part of the furnace via distribution compartment 38 and is returned to the outlet at the same furnace side. A smaller flow of air passes through openings 39 in the inner shell wall 40. The combustion chamber may be eccentrically located, which can be best seen from FIG. 11, in which is also shown an alternative location for the heat exchanger 41.

Figure 11:
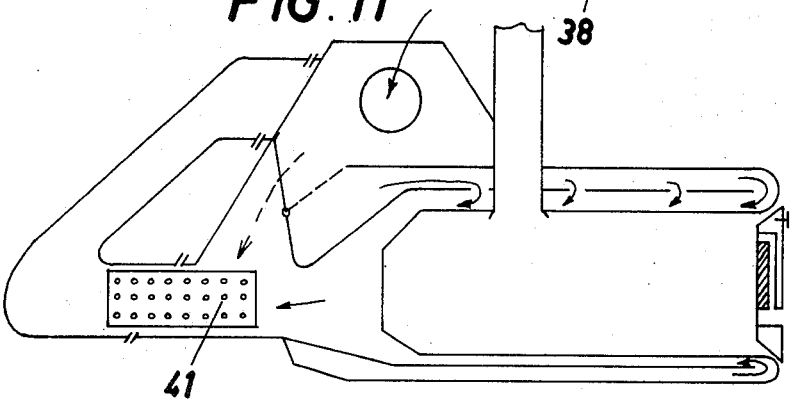
FIG. 11 is a schematic longitudinal sectional view of a further modified embodiment of the furnace according to the invention.
Figure 12:
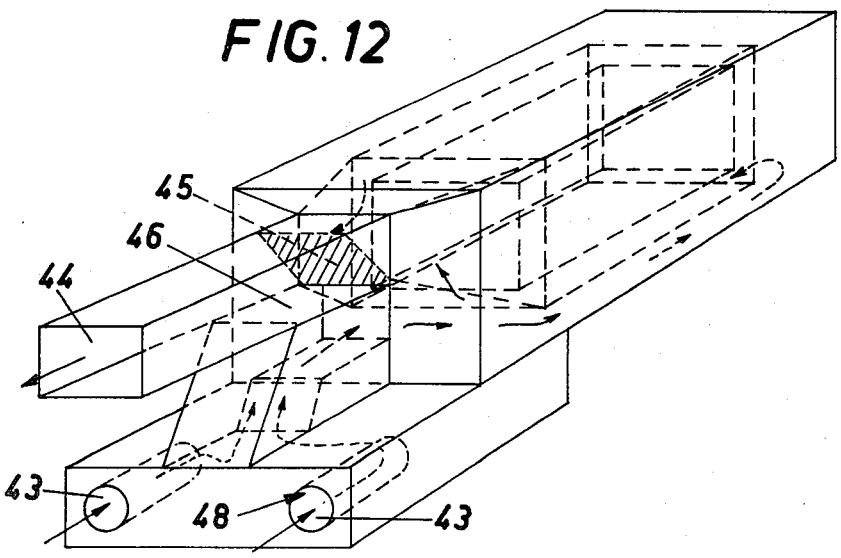
FIG. 12 is a perspective schematic view of perspective, the design principle for a square combustion chamber.
Figure 13:
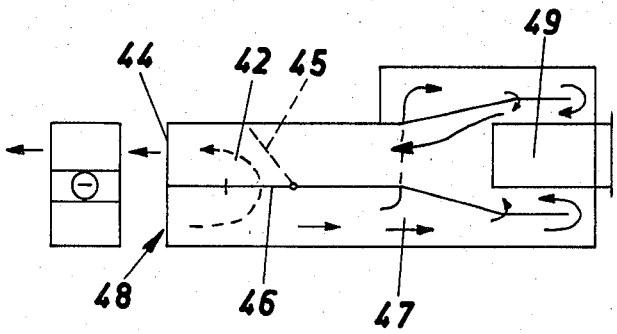
FIGS. 13*a* and 13*b* are an end view and a schematic longitudinal sectional view respectively, of the embodiment according to FIG. 12.

In FIG. 12 is shown in a ghost perspective view a furnace embodiment corresponding to FIG. 11 but having a square combustion chamber. This furnace design is shown in a schematic longitudinal section in FIG. 13. A dashed arrow 42 shows that the air by means of the blower 43 may by-pass the combustion chamber 49 and flow directly to the outlet 44. In this position the draft valve 45 is raised. When the draft valve has been lowered 46 the air will flow past the combustion chamber along the continuous lines 47. The heat exchanger, e.g a water battery, can be connected to the inlet 48 or to the outlet 44.

The invention is not limited to the embodiments shown in the drawings and described in with reference thereto but modifications and variations are possible within the scope of the following claims.

We claim:

1. In a furnace for producing hot air with solid or liquid fuels and incorporating a double-shelled combustion chamber having a fuel intake door at one end thereof and a smoke funnel, at least one blower having an inlet and an outlet arranged at the end opposite to said fuel intake door and adapted to force air to be heated through the blower outlet and into the space between said double shells, an outlet for heated air being arranged at the end of the furnace provided with said blower, the improvement comprising substantially horizontally arranged partition members in the space between said double shells to subdivide said space into an upper and a lower zone, said zones being directly adjacent the combustion chamber, and said zones taken together enclosing the combustion chamber, the outlet from said blower being arranged to communicate with said upper zone, and an opening in said partition members situated adjacent the fuel intake end of the furnace, so that the air from the blower outlet passes first through said upper zone to cool the upper part of the combustion chamber wall and thereafter through said lower zone to cool the lower part of the combustion chamber wall.

2. A furnace as claimed in claim 1, wherein a collecting and distributing compartment is arranged between said upper and lower zones for distributing air from said blower over the total section of said lower zone.

3. A furnace as claimed in claim 1 or 2, wherein baffle means are arranged in the space between said double shells for guiding the air to be heated to produce optimum flow about the combustion chamber thereby obtaining optimum heat transfer.

4. A furnace as claimed in claim 1, wherein said partition members are provided with perforations to allow additional air from said upper zone to pass into said lower zone.

5. A furnace as claimed in claim 1, and further comprising a closed guiding duct removably mountable between said blower inlet and said hot air outlet for selectively interconnecting said blower inlet and hot air outlet.

6. A furnace as claimed in claim 1 and further comprising a conduit between said blower outlet and said hot air outlet and a draft valve device adjustably arranged in said conduit for controlling the supply of air to be heated into said zones by by-passing some or all of said air through said conduit leading to said air outlet of the furnace.

7. A furnace as claimed in claim 6, wherein said blower, draft valve device and possible control equipment therefore are arranged in an integral unit which is detachably mounted to the combustion chamber.

* * * * *